United States Patent [19]

Lash et al.

[11] Patent Number: 4,557,129

[45] Date of Patent: Dec. 10, 1985

[54] MULTIPLE TOOLING ROLL FORMING MACHINE WITH TURRET TYPE ROTARY MOTION

[75] Inventors: Edward G. Lash, Huntington Woods; Roger Levy, Oak Park; Charles J. Nickels, Southgate, all of Mich.

[73] Assignee: Tishken Products Co., Detroit, Mich.

[21] Appl. No.: 646,972

[22] Filed: Sep. 4, 1984

[51] Int. Cl.[4] ..... B21D 5/08

[52] U.S. Cl. ..... 72/176; 72/181; 72/226

[58] Field of Search ..... 72/176, 179, 181, 182, 72/234, 238, 249, 449

[56] References Cited

U.S. PATENT DOCUMENTS 3,318,130 5/1967 Sendzimir ..... 72/226
4,142,393 3/1979 Nagel ..... 72/181

FOREIGN PATENT DOCUMENTS 068224 4/1982 Japan ..... 72/181
212818 12/1983 Japan ..... 72/181

*Primary Examiner*—W. D. Bray
*Attorney, Agent, or Firm*—Cullen, Sloman, Cantor, Grauer, Scott & Rutherford

[57] ABSTRACT

In a roll forming machine having a base, a motor drive, a gear drive transmission connected to the motor drive and a plurality of vertically aligned longitudinally spaced pairs of complimental pass forming rolls of progressive different shapes respectively arranged in a longitudinal set to successively receive, feed and form therebetween an elongated strip of stock in a continuous operation. Gear means interconnect the transmission and forming rolls for rotation thereof in unison. A rotatable turret mount assembly is provided to support a plurality of radially extending preset sets of form roll tooling, with each set being adapted for a different form of final product. The turret mount assembly is adapted for selected limited rotation upon a longitudinal axis to rapidly place any one of the plurality of preset sets of tooling in its operational position.

23 Claims, 6 Drawing Figures

19
21
103
99
25
29
27
151
149
137
97
139
141
101
143
135
105
145
147
148
23
R
R'
W

MULTIPLE TOOLING ROLL FORMING MACHINE WITH TURRET TYPE ROTARY MOTION

BACKGROUND OF THE INVENTION

Heretofore various types of roll forming machines have utilized standard components including a base and a top plate, a motor drive, a gear drive transmission connected to the motor drive and a plurality of vertically aligned longitudinally spaced pairs of complimental pass forming rolls of progressively different shapes. The rolls were respectively arranged in a longitudinal set to successively receive, feed and form therebetween in a continuous operation an elongated strip of metallic stock. In such a construction gear means are employed for interconnecting the transmission and the forming rolls for rotation in unison.

Roll forming machines of this type have employed a series of longitudinally spaced pairs of vertically spaced forming rolls which are power driven. The rolls are progressively fed and receive therebetween an elongated strip of stock of variable widths. As the stock passes between the respective sets of vertically aligned complimental rolls, the strip of stock as it exits the roll forming machine is of the desired predetermined configuration.

In machines of this type the individual upper form roll of each pair of vertically aligned rolls may be manually adjustable to accommodate stock of different thickness as it is formed and passes through and between the sets of rolls successively. Normally the machine once set up will form only one end product in a continuous and reptitive manner and at a relatively high speed and for high production.

Often times, however, it is a desire to provide an end product of a different shape. This necessitates the applicatio of a new set of successive pairs of longitudinally spaced rolls upon the power driven spindles such that when the new rolls are assembled and set, a strip of stock may be passed through and between the complimental rolls for a different configured end product. This requires the machine to be stopped in order to switch or replace the complimental rolls for the particular job. Additional down time is involved in providing for the required vertical adjustments of the respective upper rolls of each set of pass rolls along the length of the set of rolls from the input feeding end to the output end depending upon the nature of the cold forming of the stock that passes successively between the rolls. Additional down time time is involved in resetting the vertical distance between the upper and lower rolls as each pair of rolls throughout the system for a particular job.

SUMMARY OF THE INVENTION

An important feature of the present invention is to provide a roll forming machine having a turret mount assembly for supporting a plurality of radially extending preset sets of form roll tooling wherein each set is adapted for a different form of final product.

It is a further feature to provide in such roll forming machine a plurality of sets of roll forming tools of which there may be two or more which normally radially extend outwardly of the turret mount journaled upon the base of the machine, with only one set having a laterally extending operational position. With such a construction the turret assembly may be operated manually or by power so that any of the plurality of sets of tooling may be rotated to an operational use position for any one of a plurality of forming jobs corresponding to the number of sets of roll forming tools mounted upon the turret assembly.

Another feature is to provide a minimum of two, three or four right angularly related preset sets of roll forming tools, with the turret assembly mounting the sets being rotatable for presenting any one of the sets of tooling in a horizontal operational position.

Still another feature is to provide a roll forming machine having a plurality of sets of tooling supported upon a rotatable turret mount assembly. With such a machine in order to switch from one job to the next, all that is necessary is to quickly rotate the turret mount assembly, a limited angle as for example 90°, so as to present a new set of tooling into an operational position.

A further feature provides for a particular form of product that rotation of the turret assembly may be increments of 90°, depending upon which of the other three preset sets of roll forming tools on the turret mount assembly is to be employed. With such a construction the change over to the set of roll forming dies to be employed takes a very limited period of time, such as a few minutes, so that the roll forming machine is ready for the succession of passes of a particular width of stock through and between the respective longitudinally spaced sets of complimental rolls.

Another feature includes the provision of a drive gear secured upon the corresponding spindle of each pair of form rolls of a particular set, with the corresponding drive gears being interconnected by suitable gearing to rotate in unison. Additional gearing is employed and connected to the transmission in a manner where the drive of the motor drive and transmission is connected to the gearing, sometimes referred to as the gear means. With such a construction the gear means is adapted to power rotate the respective vertically aligned spindles of each of the longitudinally spaced sets of forming rolls of the particular set. This occurs when the particular set is rotated to a horizontal operational position. The power drive is directed only to that set of rolls in such position, with the remaining sets of rolls being inoperative.

Still another feature includes the provision of a turret mount assembly for supporting a plurality of radially extending preset sets of roll forming tooling, with each set of tooling adapted for a particular final product, and each of the plurality sets of tooling having a horizontal outwardly directed operational position. With such a construction the turret assembly is adapted for selective limited rotation of less than 360° degrees, upon a longitudinal axis to rapidly place any one of the plurality of preset sets of tooling into its operational position.

A further feature is to provide a roll forming machine having either manual or power operated means for effecting incremental rotary motion of the turret mount assembly to a position where the desired set of roll forming tools is in its operational position.

A still further feature includes a roll forming machine having a turret mount assembly, a pair of aligned trunion shafts at opposite ends thereof arranged upon a longitudinal axis and supported and journaled within apertured upright end supports upon the machine bed, and gear means selectively rotating the turren mount assembly in angular increments corresponding to the angular location of the preselected set of roll forming tools to be used.

Another feature is to provide a roll forming machine having a turret mount assembly which includes interconnected right angularly related front, rear, top and bottom plates and a pair of end plates. With such a construction a pair of aligned outwardly directed trunion shafts are secured to the end plates upon a longitudinal axis, together with apertured upright end supports mounted upon the machine bed for journaling and supporting the trunion shafts. Suitable gear means are employed for rotating the trunion shafts through an angular extent of up to 360°, for positioning one of a plurality of radially directed preset sets of tooling in a horizontal operational position.

Still another feature is to provide a roll forming machine of the aforementioned type where for each of the corresponding different preset sets of roll forming tooling mounted upon the turret mount assembly there is provided for each set of tooling a drive gear which is connected by suitable gearing to the respective spindles of the rolls for a particular set. In such a machine there is a drive gear for each of the corresponding sets, with the drive gear for any particular set being connected to the power transmission when that particular set is rotated to its operational position.

A further feature is to provide a roll forming machine provided with a transmission which includes a speed reducer connected to a motor drive and has an output shaft which mounts a first drive gear and an oscillating yoke. An oscillating drive gear is journaled upon the yoke and is in mesh with the first drive gear. In a first position of the yoke the oscillating drive gear is in operative driving engagement with the drive gear for the forming rolls. In a second position of the yoke the oscillating drive gear is disconnected from the drive gear for the forming rolls. A reciprocal clamping device is connected to the yoke for selectively moving the yoke between the first and second positions for connecting and disconnecting the power from the particular set of rolls in operational position.

A further feature of the roll forming machine includes for each of the corresponding forming and feed rolls a roll mounting spindle which is journaled and supported upon one plate of the turret mount assembly and mounts upon its inner end a drive gear and mounts upon its outer end a forming roll. With such a construction the corresponding complimental longitudinally spaced sets of vertically aligned form rolls are adapted to receive therebetween a strip of stock for progressively and successively forming the stock to a predetermined form.

A final feature is to provide a modified roll forming machine having an additional outboard support for each of the corresponding spindles of the sets of feed rolls, with the outer end portions of the corresponding spindles being mounted in bearings where heavier loads are employed.

These and other objects and features will be seen from the following Specification and claims in conjunction with the appended drawings.

THE DRAWINGS

It will be understood that the above drawings illustrate preferred embodiments of the invention and that other embodiments are contemplated within the scope of the claims hereafter set forth.

DETAILED DESCRIPTION OF AN EMBODIMENT OF THE INVENTION

Figure 1:
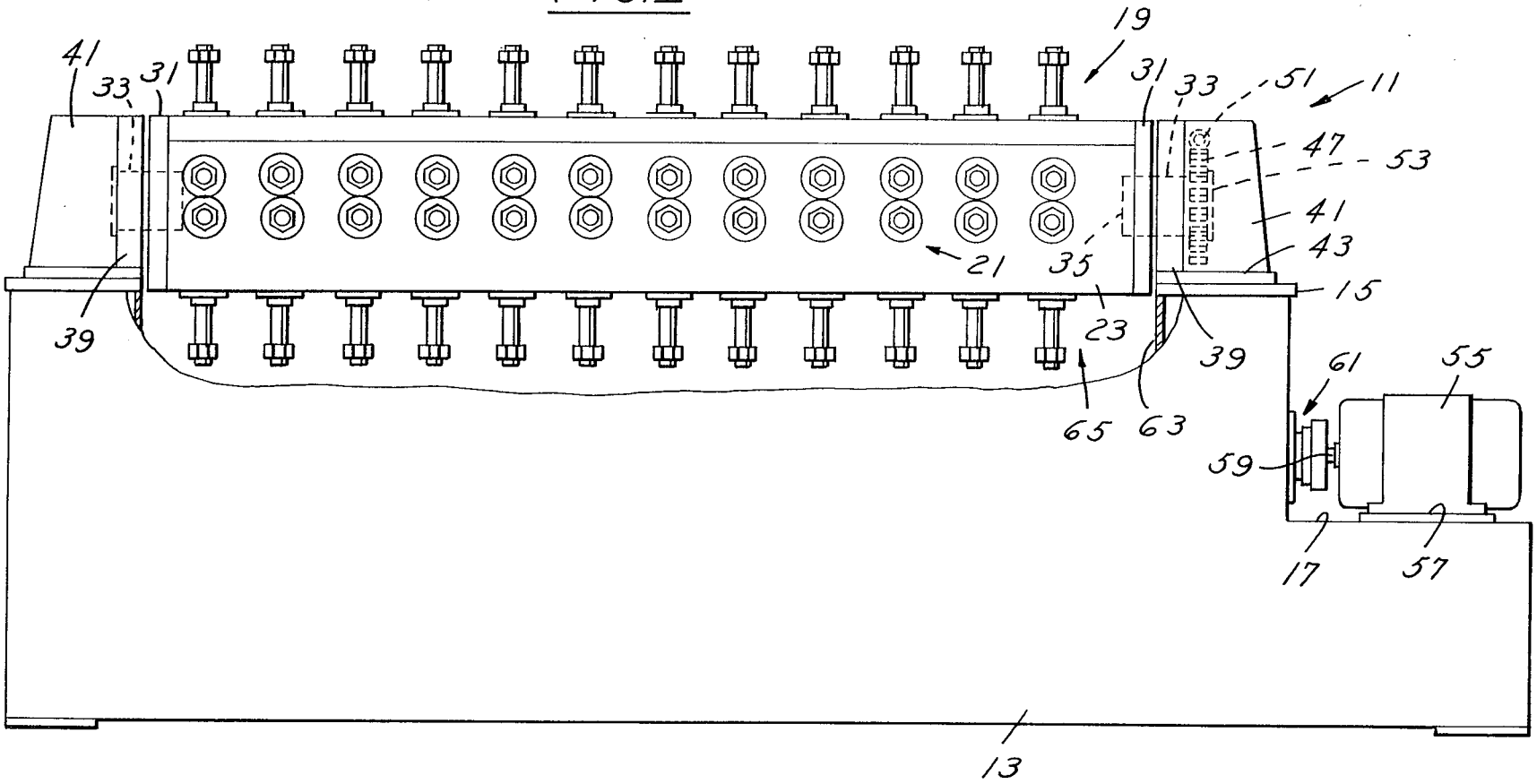
FIG. 1 is a side elevational view of the roll forming machine with a portion of the side wall of the base of the machine cut away and in section to illustrate the interior thereof.
Figure 2:
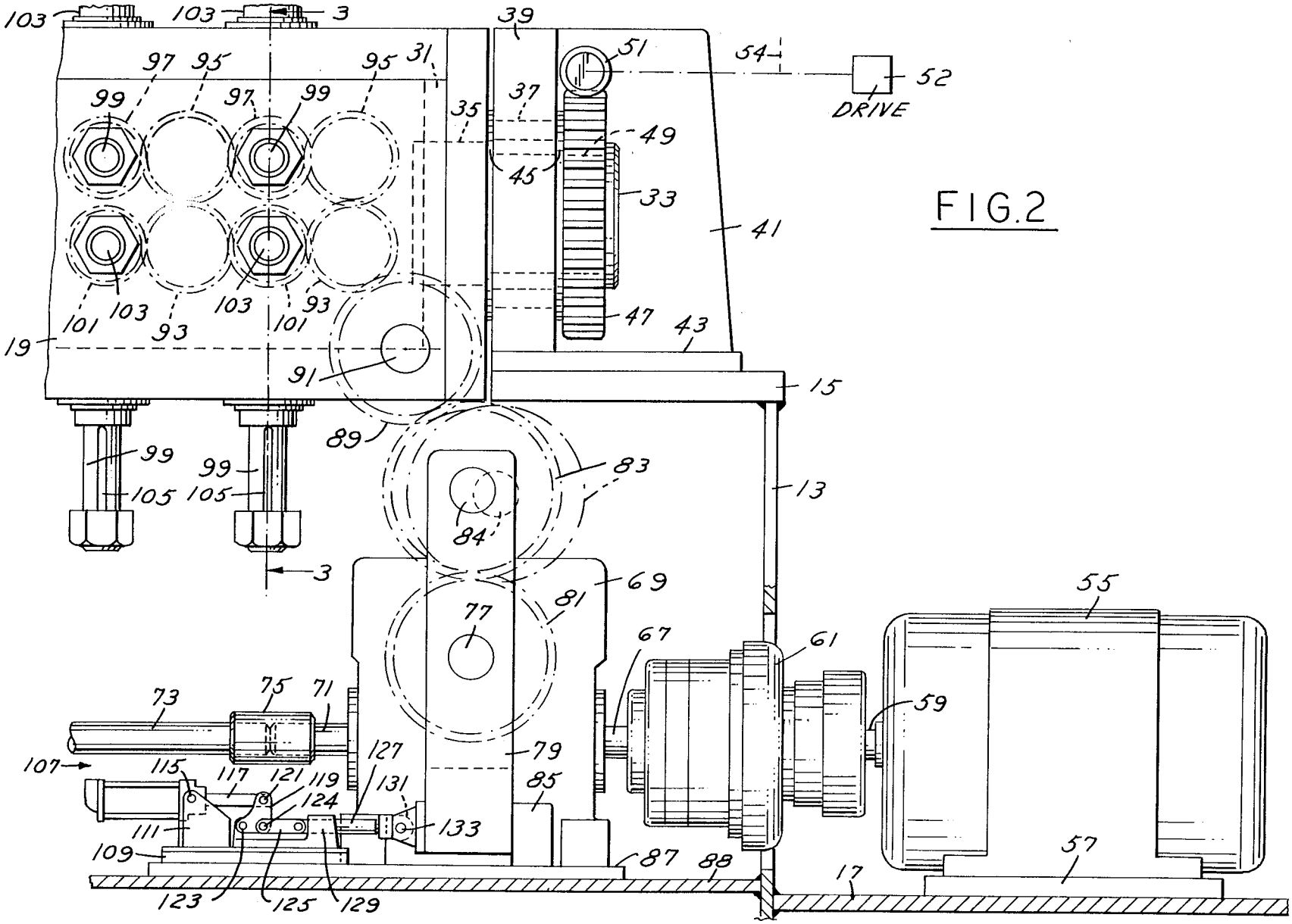
FIG. 2 is a partly sectioned, fragmentary side elevational view corresponding to FIG. 1, on an increased scale and illustrating the connection between the motor, the transmission and one set of preset forming rolls.
Figure 3:
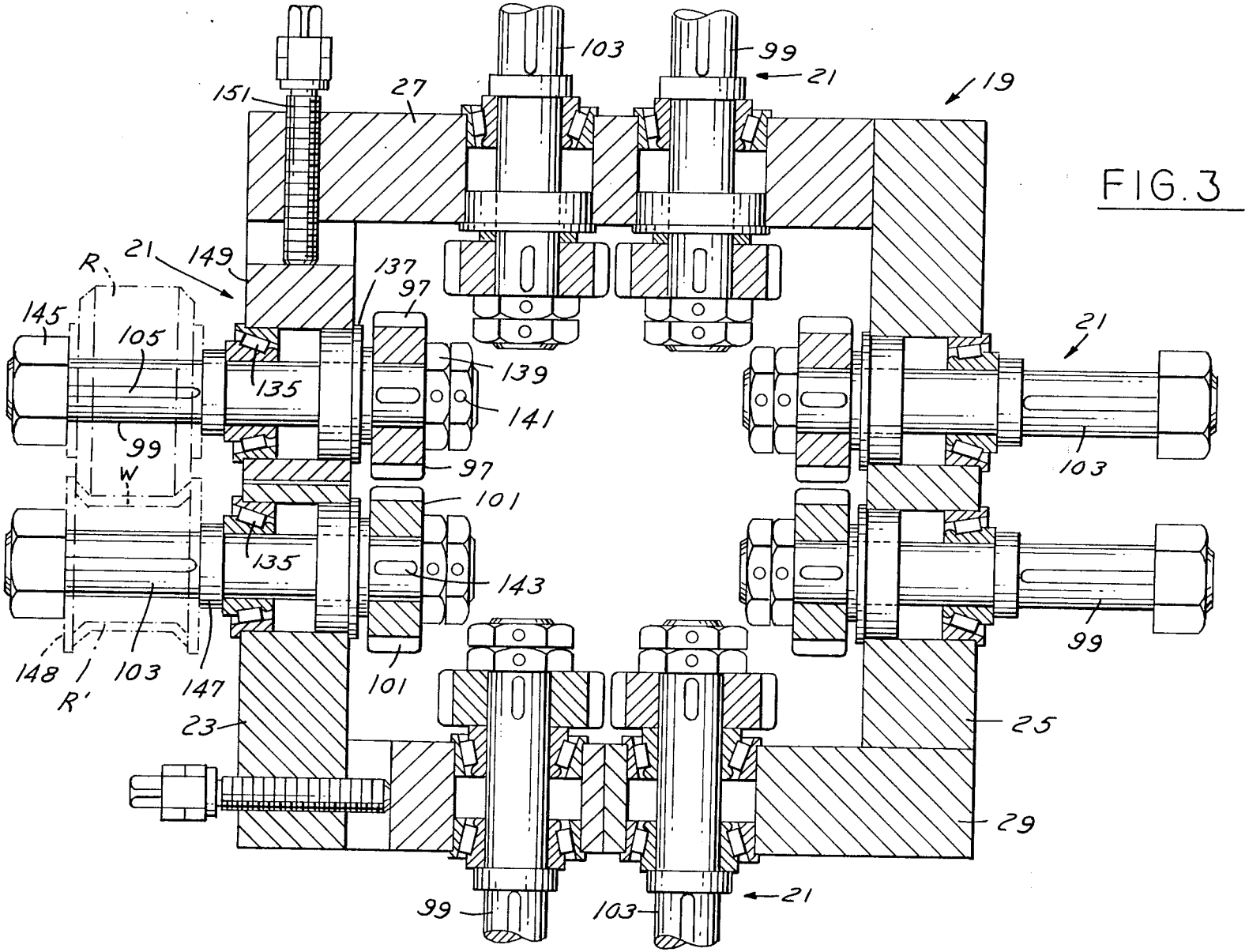
FIG. 3 is a fragmentary sectional view taken in the direction of arrows 3—3 of FIG. 2, on an increased scale.

Referring to the drawings, FIGS. 1, 2 and 3, there is illustrated a multiple tooling roll forming machine with turret type rotary motion to rapidly place into operational position anyone of four preset sets of form roll tooling, hereafter referred to as a roll forming machine 11. The roll forming machine 11 includes a base 13 mountable upon a floor surface, having a top plate 15, a motor platform 17 and a turret mount assembly 19 for four right angularly related sets of roll form tooling assemblies.

Each of the preset sets of tooling assemblies is generally indicated at 21, FIGS. 1 and 3. Turret mount assembly 19, includes a plurality of right angularly related plates namely, front plate 23, rear plate 25, top plate 27 and bottom plate 29, together with a pair of end plates 31 all secured together as a unit structure as shown in FIGS. 1 and 3.

A pair of aligned trunnion shafts or trunnion portions of shaft means 33, arranged upon the longitudinal axis of the turret mount assembly 19, are axially secured to end plates 31 at 35, FIG. 1, and project longitudinally thereof. The portions of shaft means 33 are supported within bearings or bushings 37 located in the end mount plates 39. The end mount plates 39 are bifurcated and include a pair of laterally spaced upright end supports 41 terminating in a mount flange 43. The flange 43 overlies the top plate 15 and is suitably secured thereto by fasteners. Apertured spacers 45 are mounted upon the trunnion shafts 33 and arranged upon opposite sides of each end mount plate 39. Worm wheel 47 is mounted on and keyed at 49 to one of the trunnion shafts or portions of shaft means 33, FIG. 2, and is in mesh with worm gear 51. Gear 51 is journaled between end supports 41 within suitable bearings and connected to a power drive, such as schematically shown by the box 52. Alternately, the worm gear 51 may be manually rotated as at 54. An end cap 53 is mouted over one end of trunnion shaft 33 and secured thereto adjacent worm wheel 47.

An electric motor 55 has a mount flange 57 located upon motor platform 17, FIG. 1, and is suitably secured thereto and includes drive shaft 59. Drive shaft 59 axially extends into the clutch assembly 61. The drive from the clutch 61 is axially connected to input shaft 67 of the speed reducer 69. The reducer 69 is provided with a mount flange 87 which is secured upon platform 88 forming a part of the base 13.

Figure 4:
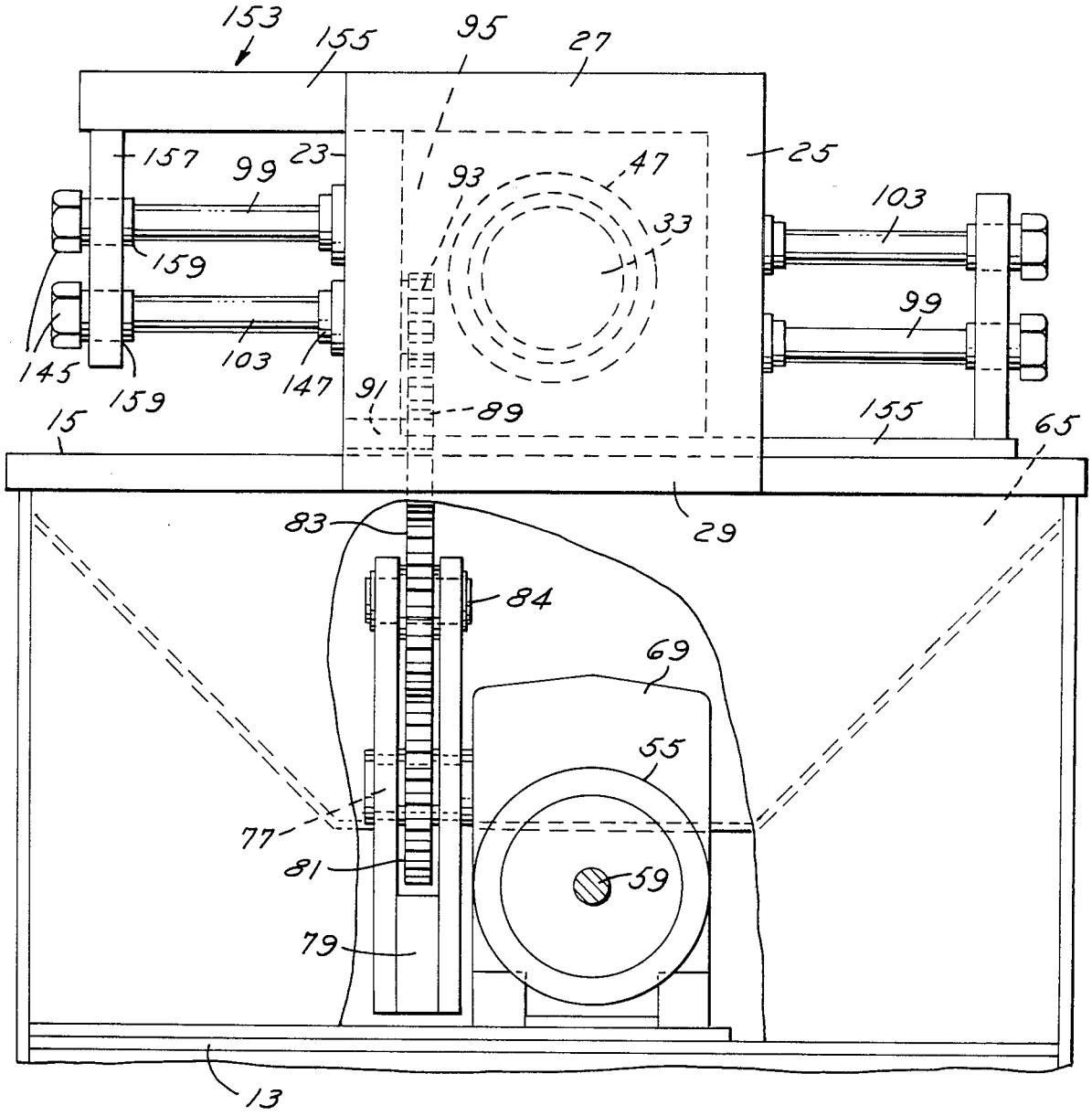
FIG. 4 is an end view, partly broken away, of a modified roll forming machine including outboard supports for the other ends of the corresponding sets of roll mounting spindles for each set of forming rolls employed and also illustrating a pair of oppositely directed sets of roll forming tools.

Speed reducer 69, FIG. 2, has a power take-off or output shaft 71 connected to an auxiliary input shaft 73 by means of a coupling 75. Speed reducer 69 has a drive shaft 77 which extends through the exterior upright yoke 79, sometimes referred to as an oscillating yoke, which is pivotally mounted upon the drive shaft 77. Drive gear 81 is positioned on the interior of yoke 79, as shown in FIG. 4. Oscillating gear 83, as shown in FIG. 2, is journaled upon stud shaft 84 adjacent the upper end of and spanning the sides of yoke 79, and is in mesh with drive gear 81.

The yoke 79 and the corresponding oscillating gear 83 has a first position, with yoke 79 in an upright position bearing against the yoke stop 85, and is rotatable to a second or disconnect position shown in dash lines, FIG. 2, thereby disconnecting the power output from the speed reducer 69 to the drive gear 89. Drive gear 89 is journaled at 91 upon the turret mount assembly 19. For each of the respective plates 23, 25, 27 and 29 there is provided separate individual preset sets of form roll tooling 21.

The interior side walls 63 for base 13, shown broken away in FIG. 1, define chamber 65 into which one or a pair of the sets of preset tooling form roll 21 may project during intermittent rotation of turret mount assembly 19.

Oscillating gear 83 is mounted within and journaled upon oscillating yoke 79 and is in mesh with drive gear 81. Drive gear 81 defines a gear drive transmission which is connected through clutch 61 to the motor drive 59. The transmission is adapted for supplying driving power successively to the respective roll drive gears 89 for each of the corresponding sets of roll form tools 21, depending upon the rotated position of turret mount assembly 19.

FIG. 2 fragmentarily illustrates the positioning of turret mount assembly 19 with one of its sets of form roll tooling 21 extending horizontally outward in a operational position. In the illustrative embodiment, this position corresponds to the positioning of the turret mount assembly 19 shown in FIG. 3. The operating position corresponds to the form rolls journaled upon front plate 23 of the turret mount assembly 19.

There is provided a gear means which interconnects the transmission to the corresponding preset sets of forming rolls 21. This starts with the roll drive gear 89 which is in mesh with lower idler gear 93 and in turn is in mesh with upper idler gear 95 journaled upon the corresponding plate 23 of the turret mount assembly 19. The top idler gear 95 is in driving mesh with the first roll spindle drive gear 97 of top spindle 99 of the vertically aligned first spindles 99 and 103. The lower idler gear 93 is in mesh with lower roll spindle drive gear 101.

Each of the respective preset sets form roll tooling 21 include longitudinally spaced vertically aligned pairs of complimental pass forming rolls R and R′ FIG. 3. Each of the preset sets of roll forming tools correspond to and are mounted on each of the turret plates 23, 25, 27 and 29. Each set of rolls includes a plurality of vertically aligned longitudinally spaced pairs of complimental pass forming rolls R, R′ keyed at 105 upon end portions of the corresponding upper and lower spindles 99 and 101.

For each of the sets 21 of preset forming rolls, there are provided in mesh with the corresponding roll drive gear 89 the intermeshing upper and lower idler gears 93 and 95 in meshing, driving engagement with the corresponding drive gears 97, 91 upon the first of the respective sets of rolls and their corresponding supporting spindles 99 and 103, FIGS. 2 and 3.

Each of the longitudinally spaced pairs of roll driving spindles 99 and 103 have mounted thereon upon their inner ends the corresponding spindle drive gears 97 and 101, FIG. 3. Interposed between the upper spindles of the upper set of rolls for each preset set of forming rolls are a plurality of idler gears 95 which interconnect the adjacent spindle drive gears 97 so that all of the corresponding upper spindles rotate in unison under the primary drive from roll drive gear 89.

A corresponding lower series of longitudinally spaced idler gears 93 are interposed between the corresponding lower roll drive gears 101 of each of the spindles 103 so that the lower spindles forming a part of the set of forming rolls all rotate in unison with each other and with the upper set of roll supporting spindles. The lower set of spindles 103 for the corresponding lower rolls R′ in a particular set are therefore under the drive of roll drive gear 89, idler 93, drive gear 101 and the additional intermediate idler gears 93.

In operation when turret mount assembly 19 has been rotated to a preselected position, with one set of forming rolls in a horizontal operational position, such as designated upon the plate 23, FIG. 3, the roll drive gear 89 corresponding to that set of rolls is in mesh with the oscillating gear 83 when yoke 79 is in its upright first position, FIG. 2.

A suitable clamping means is provided by which yoke 79 is secured in an upright position against stop 85 to assure that the oscillating drive gear 83 is in mesh with the corresponding roll drive gear 89. This provides a drive to all of the gears which form a part of the train of gears for rotation in unison of the vertically aligned longitudinally spaced pairs of spindles and corresponding complimental forming rolls R, R′.

In the illustrative embodiment, the clamping means shown in FIG. 2 includes a toggle mechanism or clamp 107 adapted for holding the oscillating gear 83 in mesh with roll drive gear 89 for the corresponding set of rolls when in the horizontal operational position upon turret plate 23 as shown in FIGS. 2 and 3. The toggle mechanism 107 has a support 109 secured upon plate 87 and includes upright bifurcated bracket 111. A pneumatic cylinder assembly 113 at its forward end is interposed within bracket 111 and is pivotally mounted thereon at 115. The cylinder assembly 113 includes a piston, not shown, and the reciprocal piston rod 117 at its outer end connected to toggle link 119 by pivot pin 121. Toggle link 119 is pivotally mounted at 123 on support 109 and is pivotally connected at 124 to one end of link 125.

The other end of the link 125 is pivotally connected to the outer end of reciprocal shaft 127 which is guidably mounted at 129 upon support 109. The stirrup 131 upon the outer end of shaft 127 is pivotally connected at 133 to the lower portion of yoke 79.

In FIG. 2, the piston rod 117 is in an advanced position, which through the toggle link 119 has advanced the shaft 127 thereby rotating the yoke 79 in a counterclockwise direction around its supporting shaft 77 till the yoke 79 engages stop 85. At that point, the oscillating gear 83 journaled upon the yoke 79 and driven by the speed reducer driven gear 81, is in mesh with the corresponding roll drive 89 upon one side of the turret mount assembly 19.

To rotate the yoke 79 to its second or disconnect position, the air connections to the pneumatic cylinder 113 are reversed so that the piston rod 117 retracts and through toggle link 119 retracts shaft 127 thus rotating the yoke 79 in a clockwise direction. Here the oscillating gear 83 is disconnected from the roll drive gear 89, as shown in dash lines, FIG. 2.

The corresponding vertically aligned spindles 99 and 103 for each of the longitudinally spaced pairs of rolls R, R′ extend through corresponding turret plate 23 and through corresponding bearings 135 retained thereon. Each of the spindle drive shafts 99 and 103 have spacer collars 137, FIG. 3, which engage one side of the respective plate 23. The corresponding spindle drive gears 97 and 101 are keyed thereon at 143 and secured thereto by fasteners 139. Lock pins 141 secure fasteners 139 upon the corresponding spindle.

The corresponding spindles project through plate 23 and the other plates 25, 27 and 29 and have keyed thereon as at 105 the corresponding complimental upper and lower forming rolls R, R′. These are secured thereon by the fasteners 145. Each of the spindles includes a stop collar 147, FIG. 3. The fasteners 145 engage roll retaining washers 148.

The above description with respect to one preset set of rolls such as the rolls R, R′ in FIG. 3, corresponding to the outwardly facing horizontal rolls in FIG. 1, also applies to the additional different preset sets of roll form tooling 21 journaled upon and projected at right angles to the corresponding additional plates 25, 27 and 29 of the turret mount assembly 19. Their description is not repeated.

For any set of preset rolls including the vertically aligned longitudinally spaced complimental rolls R, R′, it is understood as is conventional on this art, the corresponding pairs of rolls of complimental form are of progressively different shapes so that a strip of stock or material such as the workpiece W, FIG. 3, is adapted to pass between and is frictionally driven by the corresponding upper and lower rolls of the succeeding longitudinally spaced sets of complimental rolls until the elongated strip of stock in its final form outlets or exits at the left end of the roll forming machine 11, FIG. 1.

Though not a part of the present invention, it is contemplated that a suitable holder or other support for a roll of stock is provided for feeding the stock W longitudinally into and between the first of the forming rolls R, R′ at the right end of the roll forming machine 11, FIG. 1. The stock is progressively formed by the complimental longitudinally spaced sets of rolls until the stock reaches its final cross sectional shape for a particular job or product.

As is conventional in this art, provision is made for vertical adjustment of the upper spindles in each of the longitudinally spaced sets of rolls to adjust the center distance between the spindle diameters and the corresponding rolls to accommodate the stock W as it is passed between the pairs of forming rolls. This provides the correct amount of forming pressure applied to the stock by by the respective rolls.

For this purpose there is employed for the upper spindles 99 an indirect mounting therefor, with the corresponding spindles within their bearings 135, FIG. 3, are each journaled through an adjustable yoke 149. Each yoke is under the control of a vertical adjustment screw 151. For each of the upper spindles 99 of any particular preset set of rolls, there is therefor provided a manual means of adjusting the center distance between the upper spindle 99 and the lower spindle 103 employing the adjusting screws 151. These are threaded through the adjacent right angularly related plate 27. The screws 51 are in operational locating engagement with the corresponding upper spindle supporting yoke 149. Further detail as to the function and operation of the adjustment feature for the upper spindles is omitted, since this construction is conventional in the art. Each turret mount assembly 19 supports four radially preset sets 21 of the form roll tooling as shown in FIG. 3. The turret mount assembly 19 has one of the sets 21 in an operational position and is adapted for limited rotation of 90° and 180° about the longitudinal axis to rapidly place another one of the preset sets 21 in the operational position.

MODIFIED OUTBOARD SPINDLE MOUNT ASSEMBLY

Figure 5:
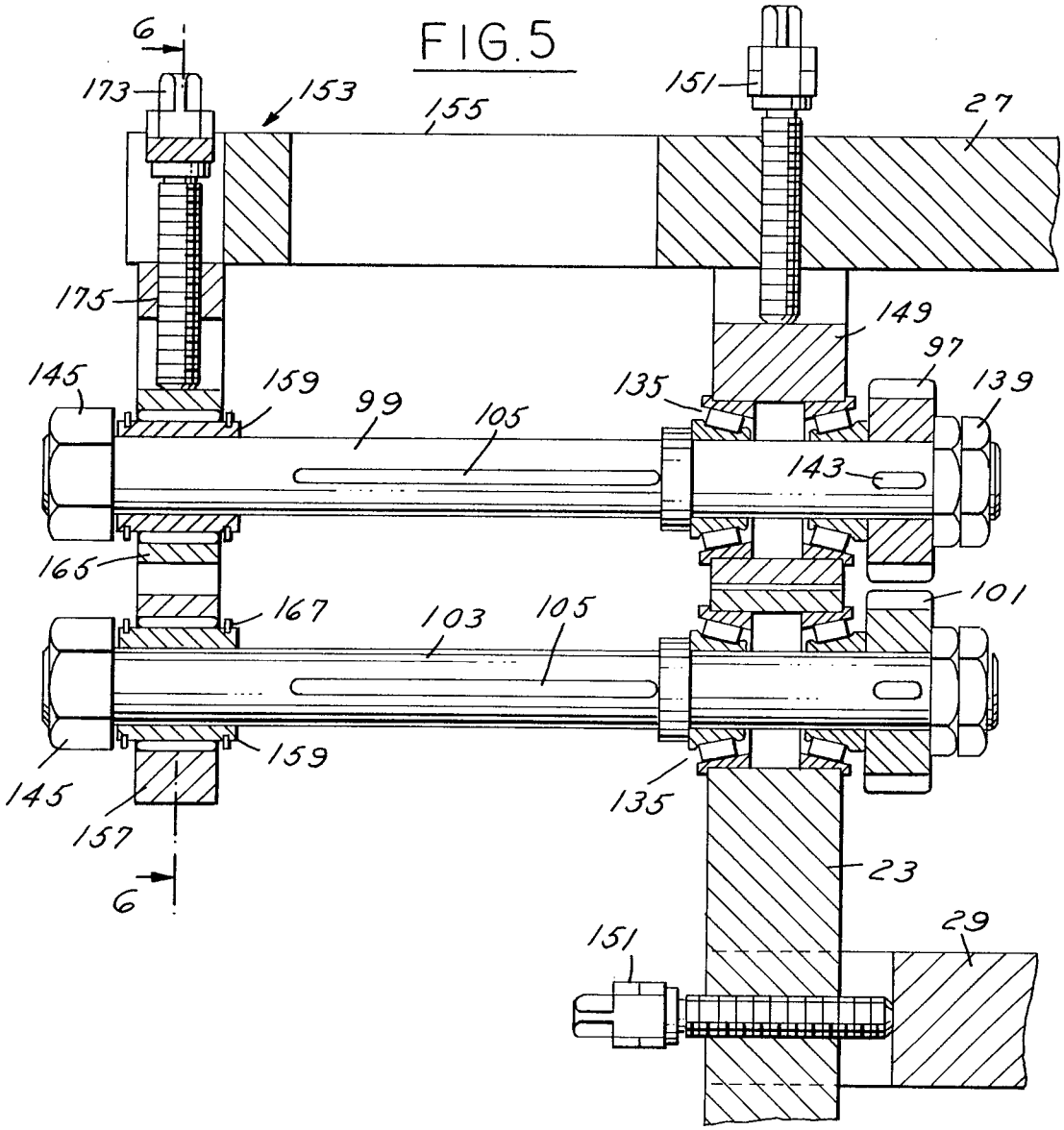
FIG. 5 is a sectional view corresponding to the upper portion of the modified roll forming machine shown in FIG. 4, on an increased scale and illustrating the outboard support for the corresponding sets of roll supporting spindles.
Figure 6:
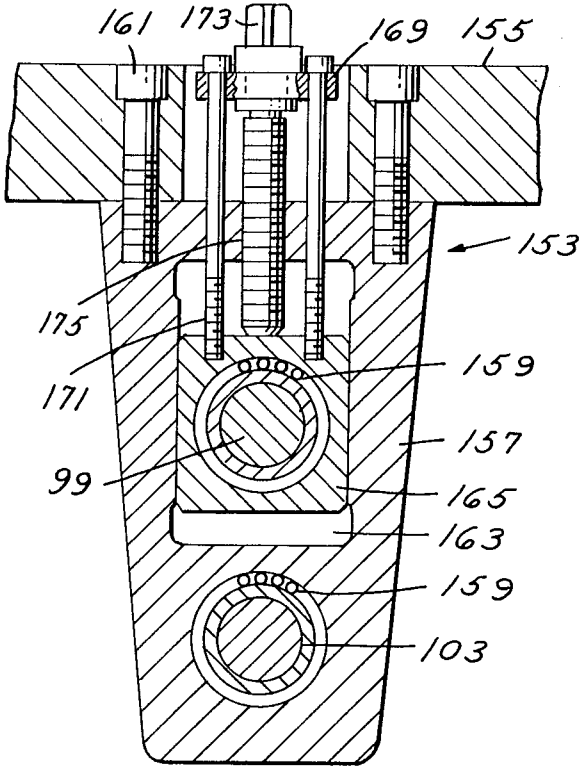
FIG. 6 is a transverse sectional view taken in the direction of arrows 6—6 of FIG. 5.

A modified outboard spindle mount assembly is generally indicated at 153, FIGS. 4, 5 and 6, and further illustrates means for vertically adjusting the upper spindle supporting yoke 165 for regulating the center distance the upper and lower spindles, FIG. 6.

The construction and mounting of the corresponding upper and lower spindles 99 and 103, FIG. 5, is substantially the same as shown in FIG. 3 and its description is not repeated. For forming rolls of increased length requiring a longer support spindle, it is advantageous to provide an outboard support for the respective spindles to take up the load and stress during the cold forming of the stock as it passes between the adjacent complimental forming rolls.

For this purpose there is provided and connected to two or to all of the plates 23, 25, 27 and 29 an extension arm 155. A pair of such extension arms 155 are shown in FIG. 4 which project from the corresponding top and bottom plates 27 and 29 outwardly thereof and which extend along the length of the corresponding plate.

Longitudinally spaced apertured outboard spindle supports 157 extend at right angles to the corresponding extension arm 155 and are suitably secured thereto by fasteners 161, FIG. 6. Each of the outboard spindle supports 157 mount a pair of vertically spaced ball bearing assemblies 159 journalling, receiving and supporting the outer ends of the corresponding roll spindles 99 and 103. Vertically adjustable yoke 165 is positioned within an upright slot 163 in each of the outboard spindle supports 157 and mount corresponding upper ball bearing assembly 159 to receive upper spindle 99.

Yoke 165 by a suitable dove tail or other guide connection is vertically adjustable upon the corresponding spindle support 157. The corresponding bearing assemblies 159 are respectively mounted on support 157 or on yoke 165 and retained by the spaced snap rings 167, FIG. 5.

Yoke support 169, FIG. 6, receives a pair of depending yoke mount bolts 171 which are threaded into yoke 165. The yoke adjusting screw 173 mount support 169 is threaded at 175 through a portion of outboard support 157. This provides a means for vertically adjusting the yoke 165 and the corresponding outer ends of the respective upper spindles 99. This corresponds to any vertical adjustment of the inner ends of the corresponding upper spindles such as shown in FIG. 5.

The turret assembly is adapted for selective limited rotation upon its longitudinal axis to thereby place any one of the plurality of preset sets of complimental forming rolls in its horizontal operational position.

Having described our invention, reference should now be had to the following claims:

We claim:

1. In a roll forming machine having a base, a top plate on the base, a motor drive, a gear drive transmission connected to the motor drive and a plurality of vertically aligned power rotated longitudinally spaced pairs of complimental forming rolls arranged in a longitudinal set to successively receive therebetween an elongated strip of stock in a continuous operation, and gear means interconnecting said transmission and forming rolls for rotation thereof in unison;

the improvement comprising a turret mount assembly supporting a plurality of radially extending preset sets of form roll tooling, each set being adapted for different form of product, one of said sets having a horizontal outwardly directed operational position, said turret assembly adapted for selected limited rotation upon a longitudinal axis to rapidly place any one of said plurality of preset sets in operational position;

said turret mount assembly including a pair of aligned outwardly directed trunnion shafts located upon said axis;

a pair of apertured upright end supports secured upon said top plate receiving said trunnion shafts; and rotatable gear means on one end support and one trunnion shaft for rotating said turret mount assembly and one of said sets of tooling to operational position.

2. In the roll forming machine of claim 1, said sets being in alignment and oppositely directed, said rotation from one set to the other being 180°.

3. In the roll forming machine of claim 1, said sets being right angularly related, said rotation between adjacent sets being 90°.

4. In the roll forming machine of claim 1, said gear means including a worm gear journaled upon one end support, adapted for connection to a rotary power source; and a worm wheel keyed upon said trunnion shaft and in mesh with said worm gear.

5. In the roll forming machine of claim 4, said power source being manual.

6. In the roll forming machine of claim 4, said power means being operated by an electric motor.

7. In a roll forming machine having a base, a top plate on the base, a motor drive, a gear drive transmission connected to the motor drive and a plurality of vertically aligned power rotated longitudinally spaced pairs of complimental forming rolls arranged in a longitudinal set to successively receive therebetween an elongated strip of stock in a continuous operation, and gear means interconnecting said transmission and forming rolls for rotation thereof in unison;

the improvement comprising a turret mount assembly supporting a plurality of radially extending preset sets of form roll tooling, each set being adapted for different form of product, one of said sets having a horizontal outwardly directed operational position, said turret assembly adapted for selected limited rotation upon a longitudinal axis to rapidly place any one of said plurality of preset sets in operational position;

said turret mount assembly including interconnected right angularly related front, rear, top and bottom plates and a pair of end plates;

a pair of aligned outwardly directed trunnion shafts secured to said end plates respectively, upon said axis; and a pair of apertured upright end supports secured upon said top plate journaling said trunnion shafts.

8. In the roll forming machine of claim 7, and rotative gear means on one of said end supports and one trunnion shaft for rotating said turret mount assembly and one of said sets of tooling to operational position.

9. In the roll forming machine of claim 7, said preset sets of form roll tooling being mounted and journaled upon each of said front, rear, top and bottom plates respectively and extending radially outward thereof.

10. In the roll forming machine of claim 7, each preset set of form roll tooling being mounted upon one of said turret plates respectively and including when in operational position vertically aligned longitudinally spaced pairs of spindles, intermediate their ends projected through and journaled upon said plate;

said gear means including a drive gear secured upon the inner end of each spindle; and complimental form rolls mounted and secured upon the outer ends of each pair of vertically aligned spindles.

11. In the roll forming machine of claim 10, said gear means further including a first series of idler gears journaled upon said plate interposed between and in mesh with the corresponding upper drive gears of each set of spindles; and a second series of idler gears journaled upon said plate interposed between and in mesh with the corresponding lower drive gears of each set of spindles, whereby the respective upper and lower longitudinally spaced spindles rotate in unison.

12. In the roll forming machine of claim 11, said gear means further including a pair of vertically aligned meshing idler gears journaled upon said plate and in mesh respectively with the drive gears upon the first pair of vertically aligned spindles; and a roll drive gear journaled upon said plate in mesh with one of said vertically aligned meshing idler gears.

13. In the roll forming machine of claim 11, said gear means further including idler gears journaled upon said plate interposed between and in mesh with the corresponding upper and lower drive gears of each set of spindles respectively, whereby the respective upper and lower longitudinally spaced spindles rotate in unison and in opposite directions;

a pair of vertically aligned meshing idler gears journaled upon said plate in mesh with the drive gears, respectively of the first pair of spindles; and a roll drive gear journaled upon said plate in mesh with one of said vertically aligned meshing idler gears.

14. In the roll forming machine of claim 10, said gear means interconnecting the drive gears of said spindles for rotation in unison, and for driving the first spindle drive gears; and a roll drive gear journaled upon said plate in mesh with and connected to said spindle drive gears and further connected selectively to said transmission.

15. In a roll forming machine having a base, a top plate on the base, a motor drive, a gear drive transmission connected to the motor drive and a plurality of vertically aligned power rotated longitudinally spaced pairs of complimental forming rolls arranged in a longitudinal set to successively receive therebetween an elongated strip of stock in a continuous operation, and gear means interconnecting said transmission and forming rolls for rotation thereof in unison;

the improvement comprising a turret mount assembly supporting a plurality of radially extending preset sets of form roll tooling, each set being adapted for different form of product, one of said sets having a horizontal outwardly directed operational position, said turret assembly adapted for selected limited rotation upon a longitudinal axis to rapidly place any one of said plurality of preset sets in operational position;

said transmission including a speed reducer having an input shaft connected to said motor drive and an output shaft mounting a first drive gear;

an oscillating yoke pivotally mounted upon said ouptut shaft and enclosing said first drive gear;

an oscillating drive gear journaled upon said yoke in mesh with said first drive gear and in a first position of said yoke in driving engagement with the gear means for said forming rolls, and in a second position disconnected from said gear means; and a reciprocal clamp means connected to said yoke for moving and retaining said yoke in said first position, and selectively pivoting said yoke to said second position.

16. In the roll forming machine of claim 15, each of said preset sets of form roll tooling including a roll drive gear drivingly connected to the rolls of each set of tooling respectively, said oscillating drive gear adapted for selective connection with the roll drive gear of one set of rolls when in its operational position and adapted for connection to any other roll drive gear and its corresponding set of rolls when in its operational position.

17. In the roll forming machine of claim 15, said gear means interconnecting the drive gears of said spindles for rotation in unison and for driving the first pair of spindle drive gears; and a roll drive gear journaled upon said turret mount assembly for each of said sets of form roll tooling;

said oscillating gear adapted for selective connection with the roll drive gear of one set of rolls when in its operational position, and adpated for connection to any other roll drive gear when its corresponding set of rolls is in its operational position.

18. In the roll forming machine of claim 15, said reciprocal clamp means including a pneumatic cylinder assembly mounted upon said base and including a reciprocal piston rod;

a reciprocal control shaft at one end pivotally connected to said oscillating yoke; and a toggle linkage interconnecting said piston rod and the other end of said control shaft;

said piston rod when fully extended locking said yoke in its first position with its oscillating drive gear in mesh with said roll drive gear.

19. In the roll form machine of claim 15, a stop upon said speed reducer engageable with said oscillating yoke when rotated to its first position.

20. In the roll forming machine of claim 10, the support for the upper spindle of each pair of spindles for each of said sets of roll forming tooling when in its operational position, including a radially adjustable yoke guidably mounted upon said plate for receiving and journaling said upper spindle; and an adjustable screw means upon an adjacent plate connected to said yoke for individually adjusting each yoke for modifying the center distance between each pair of spindles, to accommodate workpiece thickness along its length.

21. In the roll forming machine of claim 20, an extension arm along the length of each plate at right angles and secured thereto;

a plurality of depending longitudinally spaced apertured outboard spindle supports extending at right angles to said extension arm and secured thereto, in registry with each pair of spindles, journaling and supporting the outer end of the lower spindle; and an apertured yoke adjustable and guidably mounted upon each spindle support journaling and supporting the outer end of the upper spindle.

22. In the roll forming machine of claim 21, and an adjustable screw means upon each outboard port spindle support for individually adjusting each outboard spindle support yoke for modifying the center distance between each pair of spindles.

23. In a roll forming machine having a base, a top plate on the base, a motor drive, a gear drive transmission connected to the motor drive and a plurality of vertically aligned power rotated longitudinally spaced pairs of complimental forming rolls arranged in a longitudinal set to successively receive therebetween an elongated strip of stock in a continuous operation, and gear means interconnecting said transmission and forming rolls for rotation thereof in unison;

the improvement comprising a turret mount assembly supporting a plurality of radially extending preset sets of form roll tooling, each set being adapted for different form of product, one of said sets having a horizontal outwardly directed operational position, said turret assembly adapted for selected limited rotation upon a longitudinal axis to rapidly place any one of said plurality of preset sets in operational position;

said turret mount assembly including shaft means having a pair of aligned outwardly directed trunnion portions located upon said axis;

a pair of apertured upright end supports secured upon said top plate receiving said trunnion portions; and rotatable gear means on one end support and one trunnion portion for rotating said turret mount assembly and one of said sets of tooling to operational position.

* * * * *